US009843138B2

(12) United States Patent
Blakborn

(10) Patent No.: US 9,843,138 B2
(45) Date of Patent: Dec. 12, 2017

(54) HV-INTERFACE HAVING CENTERING

(71) Applicant: ROSENBERGER HOCHFREQUENZTECHNIK GMBH & CO. KG, Fridolfing (DE)

(72) Inventor: Willem Blakborn, Inzell (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/108,828

(22) PCT Filed: Oct. 29, 2014

(86) PCT No.: PCT/EP2014/002908

§ 371 (c)(1),
(2) Date: Jun. 29, 2016

(87) PCT Pub. No.: WO2015/104033

PCT Pub. Date: Jul. 16, 2015

(65) Prior Publication Data

US 2016/0322755 A1 Nov. 3, 2016

(30) Foreign Application Priority Data

Jan. 10, 2014 (DE) ..... 20 2014 000 299 U

(51) Int. Cl.
*H01R 9/05* (2006.01)
*H01R 24/40* (2011.01)
(Continued)

(52) U.S. Cl.
CPC ..... *H01R 13/6581* (2013.01); *H01R 13/03* (2013.01); *H01R 13/53* (2013.01); *H01R 13/6215* (2013.01); *H01R 2103/00* (2013.01)

(58) Field of Classification Search
CPC ..... H01R 2103/00; H01R 24/50; H01R 9/05; H01R 9/0515; H01R 24/40; H01R 13/658
(Continued)

(56) References Cited

U.S. PATENT DOCUMENTS 5,921,801 A 7/1999 O'Sullivan
6,133,532 A * 10/2000 Lundback ..... H01R 24/564 174/88 C
(Continued)

FOREIGN PATENT DOCUMENTS

DE 4244641 C1 8/1993
DE 10335866 A1 3/2005
(Continued)

*Primary Examiner* — Gary Paumen
(74) *Attorney, Agent, or Firm* — DeLio, Peterson & Curcio, LLC; Robert Curcio

(57) ABSTRACT

A plug connector for connecting to a complementarily formed counter plug connector, having an inner conductor which is supplied with high current, and an outer conductor that surrounds the inner conductor and has an outer contact element on a front side of the plug connector for the purposes of shield transfer where the outer contact element is designed for shield transfer, being in the form of a rigid ring element having a mating surface, surrounding same in a peripheral direction, for surface mating with a complementarily formed counter mating surface of the counter plug connector, which mating surface runs transversely in relation to an insertion direction (S) of the plug connector.

19 Claims, 5 Drawing Sheets

(51) Int. Cl.

| | |
|---|---|
| ***H01R 13/6581*** | (2011.01) |
| ***H01R 13/03*** | (2006.01) |
| ***H01R 13/53*** | (2006.01) |
| ***H01R 13/621*** | (2006.01) |
| *H01R 103/00* | (2006.01) |

(58) Field of Classification Search
USPC ..... 439/63, 578–585
See application file for complete search history.

(56) References Cited

U.S. PATENT DOCUMENTS 6,561,848 B1 * 5/2003 Khemakhem ..... H01R 9/0512 439/550
7,309,247 B1 * 12/2007 Keating ..... H01R 13/5219 439/271
2006/0125434 A1 * 6/2006 Frohne ..... H02J 7/1438 318/139
2007/0275584 A1 * 11/2007 Keating ..... H01R 13/5219 439/271
2010/0216339 A1 * 8/2010 Burris ..... H01R 24/40 439/578
2011/0008998 A1 * 1/2011 Low ..... H01R 9/0521 439/578
2011/0111623 A1 * 5/2011 Burris ..... H01R 9/0524 439/578
2011/0256759 A1 * 10/2011 Kunes ..... H01R 13/11 439/578
2012/0045933 A1 * 2/2012 Youtsey ..... H01R 9/05 439/578
2012/0129383 A1 * 5/2012 Swearingen ..... H01R 9/0503 439/449
2012/0220166 A1 8/2012 Fischer
2013/0072057 A1 * 3/2013 Burris ..... H01R 13/622 439/578

FOREIGN PATENT DOCUMENTS

DE 102008012251 A1 9/2009
EP 1860744 A2 11/2007

* cited by examiner

HV-INTERFACE HAVING CENTERING

BACKGROUND OF THE INVENTION

1. Field of the Invention

The invention relates to a plug connector for connecting to a complementarily formed counter plug connector, in particular for high current or high voltage applications. The plug connector has an inner conductor for conducting a high current and an outer conductor that surrounds the inner conductor. The outer conductor serves to shield the electromagnetic fields which it surrounds. The outer conductor has, for the purposes of shield transfer, an outer contact element on a front side of the plug connector which, on connection, faces a front side of the counter plug connector.

2. Description of Related Art

Plug connectors are used generally for the detachable connection of electrical cables in order, when connected, to permit the transmission of current and/or electrical signals. A first plug connector in the form of a socket part is thereby plugged together with a second plug connector in the form of a plug part to form a plug connection.

High current plug connectors are used to transmit high electric currents, for example with amperage of more than 100 A, e.g., 200 A to 400 A, and are for example used in motor vehicles with electric or hybrid drives. The inner conductor of the second plug connector, which is designed as a plug part, can thereby have a contact blade or a contact pin projecting in an insertion direction, which is inserted into a receiving recess of the first plug connector, which is designed as a socket part, in order to establish an electrical contact between the first plug connector and the second plug connector. An inner contact element of the inner conductor of the socket part is located in the receiving recess.

It is thereby important that the space through which the inner conductor passes is shielded as completely as possible from the outside in order to protect the environment against the radiation of electromagnetic fields, and to keep electromagnetic fields away from the interior of the outer conductor. This shielding is provided through the outer conductor which is formed of an electrically conductive material, which generally surrounds the inner conductor in a tubular or similar arrangement. In the vicinity of a plug connection it is important to ensure a continuous shielding through a shield transfer between the outer conductor of the plug connector (socket part) and the outer conductor of the counter plug connector (plug part), so that no electromagnetic fields can escape outwards.

In high current plug connectors the requirement therefore exists that, while requiring little construction space, a reliable electrical contact is established between the inner conductors and the outer conductors of the plug connector and counter plug connector, whereby this contact is intended to guarantee that even under a high loading with mechanical vibrations high electrical currents are shielded and transmitted in a functionally reliable manner without the contact points being subjected to wear.

In conventional plug connectors, the shield transfer is effected through spring-mounted contact elements projecting in the insertion direction which, when the connector is plugged together, come into contact with a peripheral contact surface of the counter plug connector and slide along this in the insertion direction until the inner contact elements fully engage in one another.

However, it has transpired that such a shield transfer often leads to inadequate shielding, and that the contact points are also subjected to a high level of wear with relatively high contact resistance.

SUMMARY OF THE INVENTION

In view of the problems described, it is the object of the present invention to provide a plug connector with increased durability and reliable shielding of the inner conductor.

This problem is solved through a further development of known plug connectors which is substantially characterized in that the outer contact element is designed for shield transfer in the form of a rigid ring element having a mating surface, surrounding same in a peripheral direction, for surface mating with a complementarily formed counter mating surface of the counter plug connector, said mating surface being inclined at an angle to an insertion direction of the plug connector.

The above and other objects, which will be apparent to those skilled in the art, are achieved in the present invention which is directed to a plug connector for connecting to a complementarily formed counter plug connector, the plug connector comprising: an inner conductor which is supplied with high current, and an outer conductor that surrounds the inner conductor and has an outer contact element on a front side of the plug connector for the purposes of shield transfer; wherein the outer contact element is designed for shield transfer, being in the form of a rigid ring element having a mating surface, surrounding same in a peripheral direction, for surface mating with a complementarily formed counter mating surface of the counter plug connector, the mating surface being inclined at an angle to an insertion direction (S) of the plug connector such that the outer contact element is pressed together with an electrically conductive housing part of the plug connector for the purpose of shield transfer between the outer contact element and the conductive housing part.

The mating surface is preferably inclined, at least in sections, at an angle ($\alpha$) of more than 10°, more than 20°, or about 30° or more, and at an angle of less than 80°, or less than 50°, or less relative to the insertion direction (S) of the plug connector. Additionally, at least in sections, the mating surface tapers or widens conically in the insertion direction (S).

The mating surface faces radially inwards in the direction of an insertion opening or that the mating surface faces radially outwards.

In addition to the obliquely inclined mating surface, the outer contact element has an attachment surface running in the insertion direction (S) and/or perpendicular thereto, which lies in peripheral contact with the housing part, being pressed together there with.

The housing part is formed of aluminum. The outer contact element is formed of brass and/or bronze, the surface thereof being nickel- and/or silver-plated, in the region of the mating surface.

The plug connector may further include two, three, or more inner conductors surrounded by the outer conductor, each having an inner contact element for making electrical contact with an inner contact element of a counter plug connector.

The plug connector may include a plug part with at least one pin- or blade-formed inner contact element of the inner conductor projecting in the insertion direction, wherein the mating surface faces radially outwards and tapers conically in the insertion direction (S).

The plug connector may further include a socket part with at least one receiving recess for receiving a pin- or blade-formed contact element of a plug part, wherein the mating surface (132) faces radially inwards and tapers conically in the insertion direction (S) in which a plug part can be inserted into the socket part.

In a second aspect the present invention is directed to a plug connection for high current applications with a first plug connector and a complementarily formed counter or second plug connector the plug connector comprising: an inner conductor which is supplied with high current, and an outer conductor that surrounds the inner conductor and has an outer contact element on a front side of the plug connector for the purposes of shield transfer; wherein the outer contact element is designed for shield transfer, being in the form of a rigid ring element having a mating surface, surrounding same in a peripheral direction, for surface mating with a complementarily formed counter mating surface of the counter plug connector, the mating surface being inclined at an angle to an insertion direction (S) of the plug connector, such that the outer contact element is pressed together with an electrically conductive housing part of the plug connector for the purpose of shield transfer between the outer contact element and the conductive housing part; wherein in a plugged-together state the two outer contact elements, each designed as rigid ring elements, make electrical contact with one another such that the mating surface of the first plug connector lies flat against the mating surface of the counter plug connector.

An attachment runs in the insertion direction (S), at least in sections, through the first plug connector and the second plug connector in order to fix the plug connection in the plugged-together state in a force- and/or form-locking manner.

The attachment further includes a dowel pin element such as a bolt or a screw which passes through an axial opening in the first plug connector and the second plug connector and which presses the second plug connector against the first plug connector in the insertion direction (S).

In a third aspect, the present invention is directed to a converter including two plug connectors, an input plug connector and an output plug connector arranged next to one another, wherein each plug connector comprises: an inner conductor which is supplied with high current, and an outer conductor that surrounds the inner conductor and has an outer contact element on a front side of the plug connector for the purposes of shield transfer; wherein the outer contact element is designed for shield transfer, being in the form of a rigid ring element having a mating surface, surrounding same in a peripheral direction, for surface mating with a complementarily formed counter mating surface of the counter plug connector, the mating surface being inclined at an angle to an insertion direction (S) of the plug connector, such that the outer contact element is pressed together with an electrically conductive housing part of the plug connector for the purpose of shield transfer between the outer contact element and the conductive housing part of which the input plug connector is designed to supply an input voltage, preferably a DC voltage, to the converter, and the output plug connector is designed to conduct a converted output voltage, preferably an AC voltage, away from the converter.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1A:
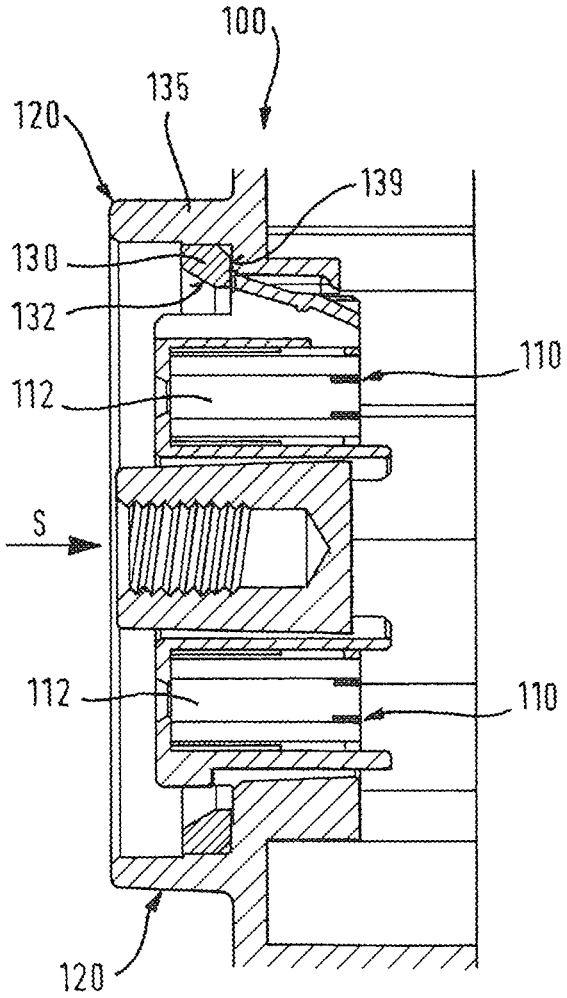
FIG. 1*a* shows a cross-sectional view of a first plug connector according to the invention in the form of a socket part, the sectional plane extending in an axial direction through the center of the plug connector.

In describing the preferred embodiment of the present invention, reference will be made herein to FIGS. 1-5 of the drawings in which like numerals refer to like features of the invention.

According to the invention, a rigid ring element is understood to mean that the ring element does not yield, or hardly yields, under the action of axial and/or radial forces on the ring element, but remains fixed in position and unmoved relative to the housing of the plug connector; that is to say, in particular, the outer contact element is not, as in conventional plug connectors, formed as a spring-mounted or resilient metal projection in the manner of one or more leaf springs or a wire mesh which, on being plugged in, is pre-tensioned and presses in sliding contact against a contact surface. Rather, the outer contact element has a peripheral mating surface which is designed to make full-surface contact with a complementarily formed counter mating surface of the counter plug connector, against which it can be pressed in an axial direction.

Ring element is understood to mean a contact element extending in a peripheral direction, through the inside of which the conductor path of the inner conductor runs in the plugged-together state. The ring element is not necessarily circularly ring-formed, but can also surround the inner conductor in the form of an ellipse, oval or similar.

Unlike conventional plug connectors, the mating surface is inclined or oblique relative to the insertion direction in a (preferably in each) sectional plane running axially through the center of the plug connector. In other words, the mating surface is neither parallel nor perpendicular to the insertion direction. Thus, the rigid mating surface can be pressed in an axial direction against a complementarily formed counter mating surface, which leads to a particularly stable and reproducible shield transfer. Due to the slope of the mating surface, neither an axial nor a radial misalignment of the plug connector when plugged into a counter plug connector is possible. In addition, this leads to the greater part of the axial and radial forces acting on the plug connection in the plugged-together state being transferred via the mating surfaces which lie in contact with one another, so that any additionally provided attachment elements are subjected to lesser shearing forces in a radial direction, which leads to an increased durability of the plug connector overall.

The shield transfer can be effected particularly reliably if the mating surface runs in an axial sectional plane, at least in sections, at an angle of more than 10°, preferably more than 20°, in particular around 30° or more and less than 80°, in particular 50° or less relative to the insertion direction of the plug connector. An angle of around 30° has proved to be particularly favorable. In this way, both radially and axially acting forces which emanate from the counter plug connector can be effectively transferred into the mating surface, so that the plug connector can be connected with a counter plug connector in a particularly stable manner. Moreover, the mating surface running at an acute angle relative to the insertion direction also leads to an automatic centering of the plug connector as it is plugged into the counter plug connector.

In terms of achieving a particularly good centering effect when plugging-in it has proved practical if the mating surface tapers or widens conically, at least in sections, in the insertion direction. The insertion direction is understood to mean the direction in which the plug connector designed as a plug part is moved towards the socket part in order couple it with a plug connector designed as a socket part.

The mating surface can thereby face radially inwards in the direction of an insertion opening or radially outwards. In the case of a plug connector designed as a socket part it is particularly advantageous if the mating surface faces radially inwards and tapers conically in the insertion direction. On the other hand, in the case of a plug connector designed as a plug part it is particularly advantageous if the mating surface faces radially outwards and tapers conically in the insertion direction. The angle of taper of the mating surface of the plug part and the counter mating surface of the associated socket part relative to the insertion direction correspond to one another, so that a full-surface contact can be achieved in the plugged-together state. Preferably, the angle amounts in each case to around 30° relative to the insertion direction.

The rigid ring element of the outer contact element can be substantially circularly ring-formed with an inner diameter of more than 4 cm, preferably more than 6 cm, in particular around 8 cm or more. A dimension of the mating surface in an axial sectional plane running through the center of the ring can amount to more than 1 cm, in particular more than 1.5 cm and less than 3 cm. A large mating surface leads to a particularly stable contact with the counter plug connector and thus to a secure and continuous shielding transfer.

According to a further, particularly important aspect of the present invention, the outer contact element is preferably fixed to an electrically conductive housing part of the plug connector for the purpose of shield transfer between the outer contact element and the conductive housing part through pressing. In other words, the outer contact element is a separate component which is pressed together with a conductive housing part of the plug connector. Pressing leads to a close surface contact, over a large area, between the ring-formed contact element and the housing part, which is advantageous in terms of achieving a good shield transfer. Also, pressing can be carried out particularly quickly and simply during the manufacture of the plug connector.

This leads to the shielding path running from the housing part of the first plug connector via the outer contact element of the first plug connector and via the outer contact element of the second plug connector to the housing part of the second plug connector. A direct contact between the two housing parts is thereby advantageously avoided. In each of these connections, according to the invention a full-surface contact over the entire periphery of the outer conductor through 360° in a peripheral direction is ensured.

For this purpose, in addition to the mating surface running obliquely to the insertion direction the outer contact element can have an attachment surface preferably running in the insertion direction and/or perpendicular thereto which lies in peripheral contact with the housing part. The attachment surface of the outer contact element can be pressed onto a complementary pressing section of the housing part. For example, a roughly cylindrical attachment surface of the ring element has a minimally greater diameter than a tubular insertion opening of the housing part, so that the ring element can be pressed into this opening.

The housing part can thereby be formed of aluminum. An aluminum housing is particularly simple and economical to manufacture and due to its conductive properties can act as an outer conductor.

In conventional plug connectors, the outer contact elements are often formed integrally with the housing part from aluminum, so that the plug connector and the counter plug connector make contact via two aluminum surfaces. However, an aluminum-on-aluminum connection has a high contact resistance which increases further over time due to a possible oxidation.

In this connection, in order to reduce the contact resistance in the shield transfer between plug connector and counter plug connector it has proved particularly advantageous if the outer contact element is made of brass and/or bronze. According to the invention, manufacturing the ring-formed outer contact element of brass and/or bronze is readily possible, since this can be manufactured as a separate component and then connected with the aluminum-housing part, for example through pressing.

According to the invention the contact resistance can be reduced to a particular degree while at the same time preventing oxidation of the surface if the surface of the outer contact elements is nickel- and/or silver-plated, in particular in the region of the mating surface. Alternatively, however, the entire outer boundary surface of the outer contact element can be nickel- and/or silver-plated.

In a particularly preferred embodiment, the plug connector according to the invention has two, three or more inner conductors surrounded by the outer conductor with in each case an inner contact element for making electrical contact with an associated inner contact element of a counter plug connector. A first inner conductor can be a current-carrying conductor and a second inner conductor can be an earth conductor, or both inner conductors can, alternatively, be current-carrying. Where three inner conductors are provided, a high-current three-phase voltage can for example be transmitted. Due to the joint shielding of all inner conductors by means of the surrounding outer conductor, a compact overall arrangement of the plug connector or the plug connection is possible.

In a first embodiment of the invention, the plug connector according to the invention is designed in the form of a plug part with at least one pin- or blade-formed inner contact element of the inner conductor projecting in the insertion direction, whereby the oblique mating surface preferably faces radially outwards and tapers conically in the insertion direction.

In a second embodiment of the invention, the plug connector according to the invention is designed in the form of a socket part with at least one receiving recess for receiving a pin- or blade-formed contact element of a plug part, whereby the mating surface preferably faces radially inwards and tapers conically in the insertion direction.

According to a further aspect, the invention relates to a plug connection for high current applications formed of two plug connectors according to the invention. The first plug connector is designed as a socket part and the second plug connector is designed as a plug part. The socket part and the plug part are connected with one another in that the plug part is introduced into the socket part in the insertion direction. In the plugged-together state the two outer contact elements, each designed as rigid ring elements, make electrical contact with one another such that the mating surface of the first plug connector lies flat against the mating surface of the second plug connector. Due to the oblique alignment of the two mating surfaces in a sectional plane running axially through the center of the plug connection, and due to the rigidity of the outer contact elements, a misalignment of the two plug connectors, either in an axial or in a radial direction, is not possible. This leads to a particularly reliable and durable shield transfer.

The full-surface contact between the two mating surfaces can be achieved in that the mating surface of the first plug connector faces radially inwards and tapers conically in the insertion direction, whereas the mating surface of the second plug connector faces radially outwards and tapers conically, at the same angle, in the insertion direction. The angle between the mating surface and the insertion axis in the axial sectional plane, around the circumference, preferably amounts to around 30°. This leads to a particularly good centering effect when plugging together the plug connector.

With regard to the materials to be used for the outer contact elements and the housing parts of the plug connector as well as with regard to the attachment of the outer contact elements to the housing parts, reference is made to the above remarks.

The plug connection can be held particularly securely in the plugged-together state through an attachment means running in the insertion direction, at least in sections, through the first plug connector and the second plug connector in order to fix the plug connection in a force- and/or form-locking manner. With the aid of the attachment means, the mating surfaces of the two plug connectors can be pressed together with a predefined axial force.

For this purpose, the first and the second plug connectors can have a dowel pin element such as a bolt or a screw which passes through an axial opening which presses the first plug connector against the second plug connector in the insertion direction. Since radial forces which can act between the plugged-together plug connectors are in particular transmitted through the mating surfaces which lie in oblique contact with one another, the dowel pin element is hardly subjected to any shearing load, which increases the durability of the dowel pin element. The dowel pin element is effectively only subjected to tensile loads. The dowel pin element can pass through one of the two plug connectors (preferably the plug part) and be screwed into a thread arranged in the opening of the other plug connector (preferably of the socket part).

The invention can, practically, be used in a converter which has two plug connectors according to the invention arranged next to one another in the form of socket parts. An input plug connector is designed to supply an input voltage, preferably a DC voltage, to the converter, and an output plug connector is designed to conduct a converted output voltage, preferably an AC voltage, away from the converter. A power supply cable for transmission of a DC voltage can have at its end a plug connector according to the invention in the form of a plug part which can be plugged into the input plug connector. In the converter, the DC voltage can for example be converted into a three-phase AC voltage. The converted AC voltage can be fed to an electric motor with the aid of a further cable, whereby the further cable has at its end a further plug connector in the form of a plug part for plugging into the output plug connector.

FIG. 1*a* shows a side view of a plug connector 100 according to the invention designed as a socket part. The plug connector has an inner conductor 110 with an inner contact element which is arranged in a receiving recess 112. The receiving recess is formed in a front surface of the plug connector 100 in such a way that a projecting inner contact element of a counter plug connector can be introduced into the receiving recess 112.

Figure 1B:
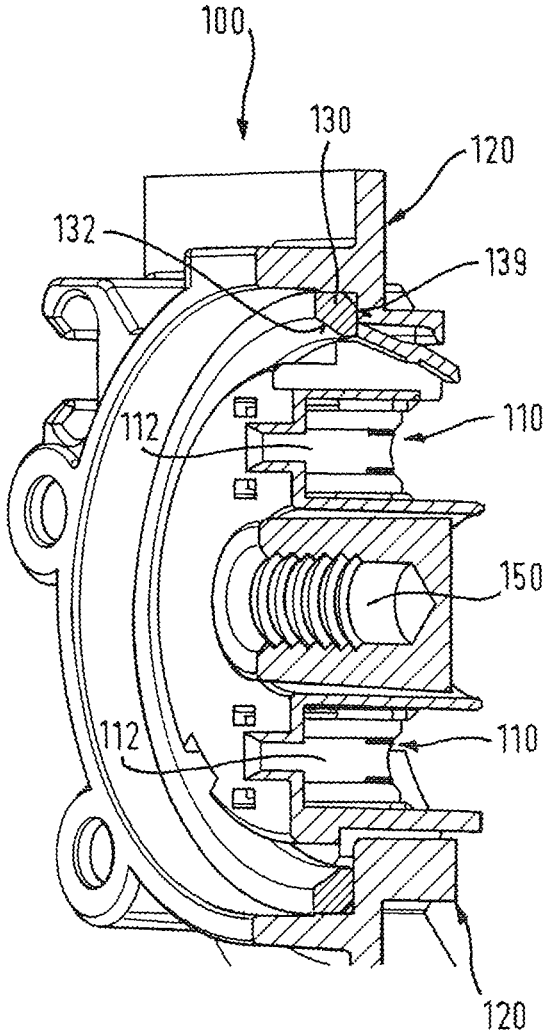
FIG. 1*b* shows a partially sectional perspective view of the socket part shown in FIG. 1*a;*

The socket part shown in FIGS. 1*a* and 1*b* have a total of two receiving recesses 112 in each of which an inner contact element is arranged which is in each case connected conductively with an inner conductor 110.

The two inner conductors 110 are surrounded peripherally by an outer conductor 120 which is formed by a part of the housing 135 of the plug connector 100. Since the housing 135 is made of conductive aluminum, the inner conductors 110 are shielded through the housing 135 in a peripheral direction. The outer conductor 120 has an outer contact element 130 on the front surface of the plug connector, in which the receiving recesses 112 are formed.

The outer contact element 130 is designed in the form of a rigid ring element which lies in peripheral contact with an inward-facing tubular wall surface of the housing 135. The outer contact element 130 is fixed to the housing 135 through pressing and there makes close contact, under pressure, with the inward-facing wall surface of the housing 135. This pressing between the outer contact element 130 (also referred to as the socket 130) and the housing 135 leads to an optimal, particularly low contact resistance between the two components, without there being any risk of contact corrosion. An inner shoulder 139 of the housing part 135 prevents the socket from pressing too far into the housing part 135 and creates a further substantially radial contact surface between socket 130 and housing 135.

The outer contact element 130 consists of brass, which can be nickel- and/or silver-plated, and the housing 135 consists of aluminum. This further reduces the contact resistance and wholly rules out the possibility of contact corrosion.

The outer contact element 130 is designed as a rigid metal element, i.e., during the plugging-in of the counter plug connector 200, which on being plugged in can exert an axially and/or radially acting force on the outer contact element 130, it remains in position and does not bend. In addition however, resilient spring elements or similar can be attached to the contact element 130 or to the housing 135 in order to further improve the contact.

Figure 3:
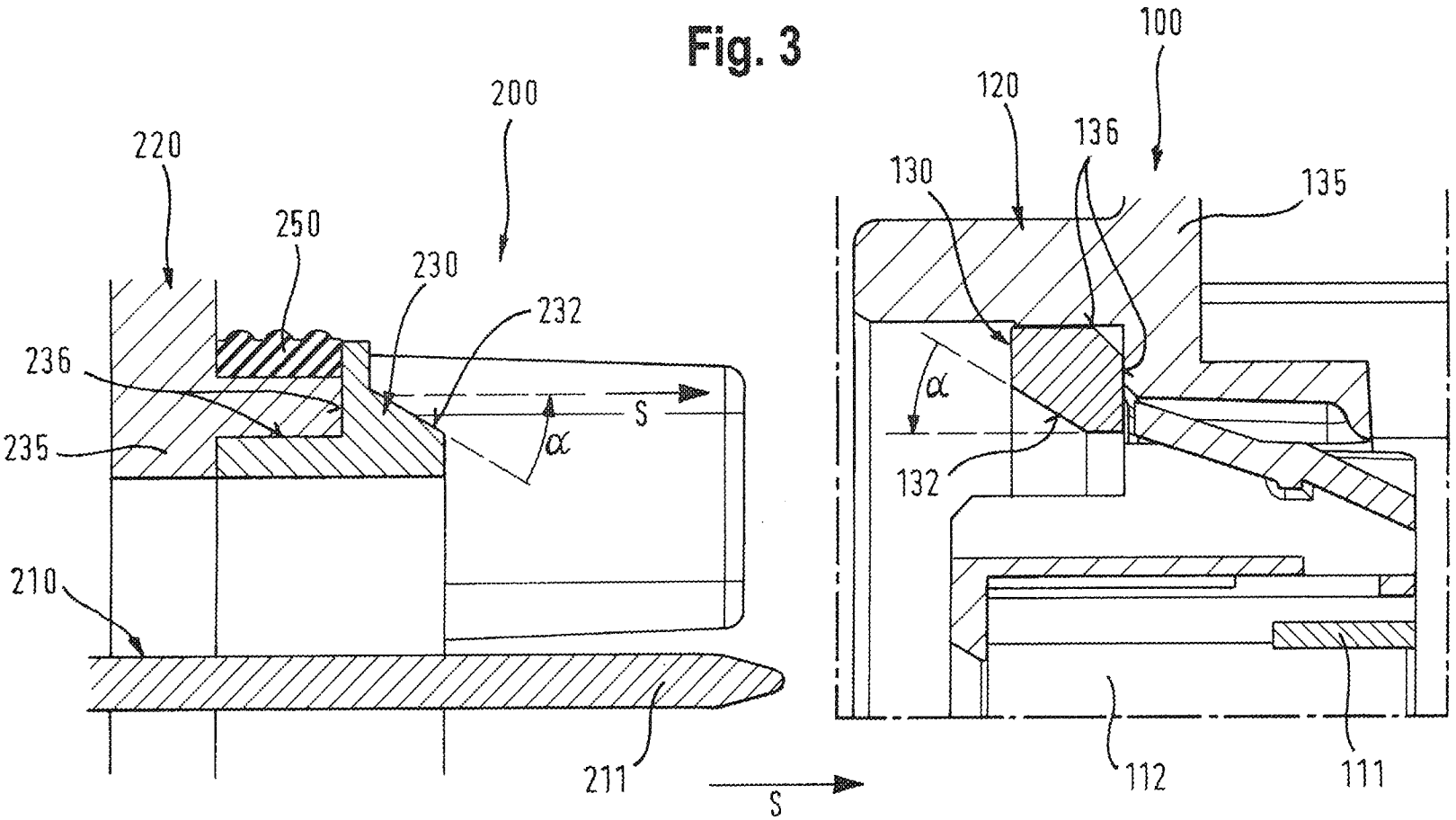
FIG. 3 shows an enlarged section of the plug connectors shown in FIG. 2 shortly before the plug part is plugged into the socket part.

The outer contact element 130 has a mating surface 132 which, in the axial sectional view in FIGS. 1*a*, 1*b*, and 3, is inclined at an angle of around 25° to 45° relative to the insertion direction S. The mating surface faces inwards in the direction of the insertion opening to allow plugging-in of the counter plug connector and thereby tapers in the insertion direction S in the manner of a cone. The mating surface is formed such that a counter mating surface of a counter plug connector tapering conically at the same angle comes into full-surface contact with it during plugging-in. This full-surface contact leads to an effective shield transfer between the outer conductor 120 of the plug connector 100 and the outer conductor of a counter plug connector.

The plug connector also has an axially aligned threaded opening 150 into which a threaded dowel pin can engage in order to fasten together the plug connector and counter plug connector.

Figure 2:
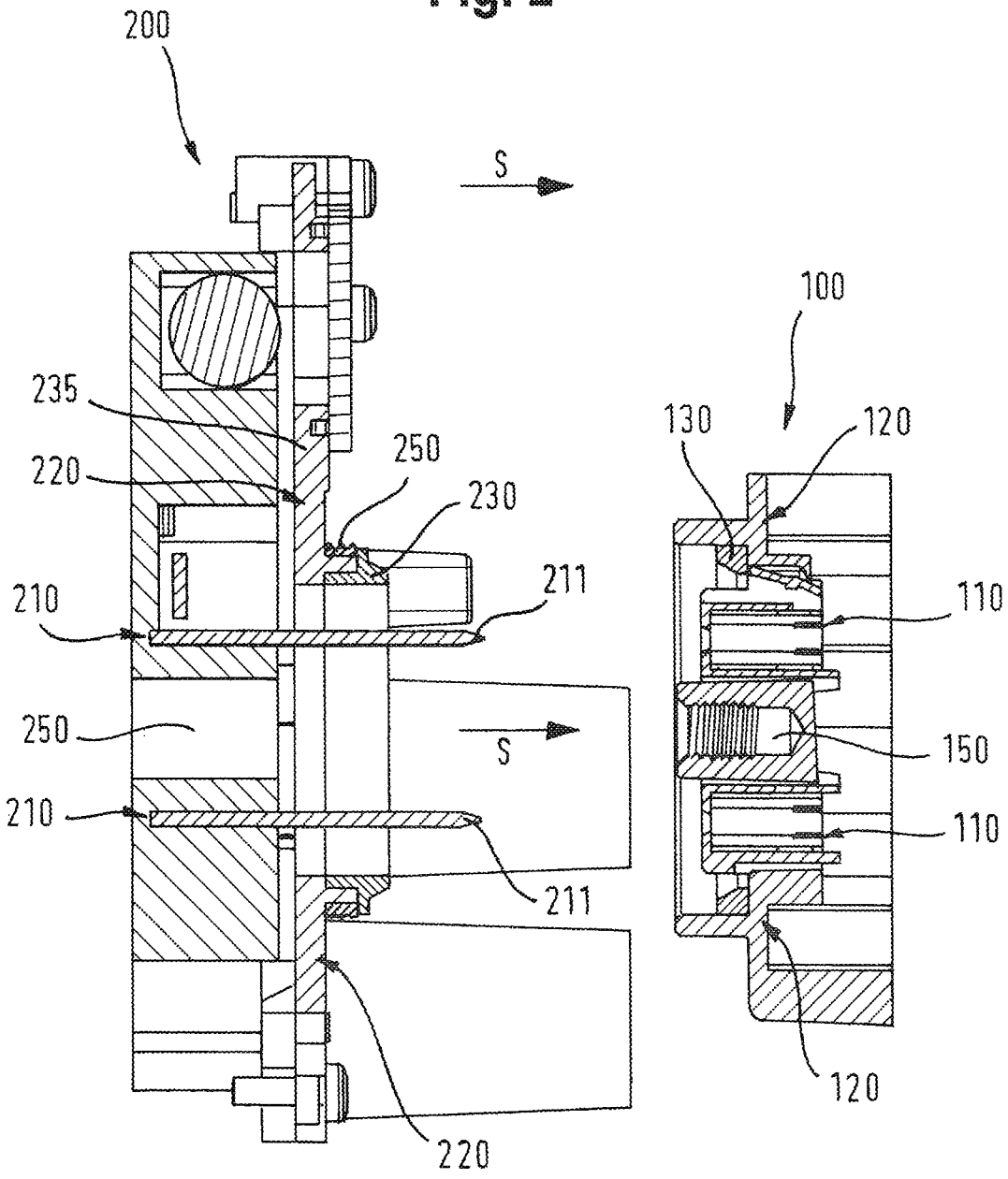
FIG. 2 shows a cross-sectional view through the plug connector according to the invention shown in FIG. 1 in the form of a socket part and a second plug connector according to the invention in the form of a plug part.

In the following, a second plug connector 200 according to the invention in the form of a plug part is described which represents the complementarily formed counter plug connector to the first plug connector 100 described above. The second plug connector is shown in FIGS. 2 to 4, in each case on the left-hand side.

The plug part has two inner contact elements 211 designed as blade-formed elements which, starting out from a front surface of the plug part, project in the insertion direction S. On their rear end, the contact elements 211 are in each case connected with an inner conductor 210 or represent a continuation of this. The inner contact elements 211 are designed to engage in the receiving recesses 112 of the socket part described above, where they make contact in the plugged-together state with the inner contact elements 111 of the inner conductor 110 of the socket part.

The inner conductors 210 are also surrounded by a common outer conductor 220 which shields the inner conductor from the outside, and which consists on the one hand of a housing part 235 of the second plug connector 200 made of aluminum and on the other hand of the outer contact element 230 which is pressed together with this. The outer contact element 230 is designed as a rigid ring-formed element made of brass, which may be nickel- and/or silver-plated and, like the outer contact element 130 of the socket part, is pressed into a tubular pressing portion of the housing 235. As a result, a pressing surface 236 of the outer contact element 230, extending in an axial direction, which completely surrounds the inner conductor, lies in close contact with the pressing portion of the housing 235. A radial contact surface 236 of the outer contact element 230 rests against a shoulder of the housing 235. This attachment leads to a particularly low contact resistance between the outer contact element 230 and the housing 235, ensuring "lifetime" prevention of contact corrosion.

The outer contact element of the plug part has a ring-formed, outward-facing peripheral mating surface 232 intended to make contact with the mating surface 132 of the socket part. The mating surface 232 tapers conically in the insertion direction S at an angle of around 25° to 45°, in particular around 30°, relative to the insertion direction S. This allows the mating surface 232 to be pressed closely and over a wide surface area against the mating surface 132.

This pressure is applied with the aid of a bolt element (not shown) which is screwed through an axial opening 250 of the plug connector 200 into the threaded opening 150 of the plug connector 100. The oblique angulation of the mating surfaces 132, 232 leads on the one hand to an automatic centering of the plug connector 100, 200 when the bolt element is tightened and on the other hand means that the bolt element is only subjected to tensile loads, not shear loads. Instead, shear forces are transmitted via the mating surfaces, which are aligned, in contact with one another, at an acute angle relative to the insertion direction S.

A sealing element 250 is arranged between the outer conductor 220 of the plug connector 200 and the outer conductor 120 of the plug connector 100, so that a penetration of moisture into the interior of the plug connection is prevented. The effect of the sealing element 250 is illustrated particularly clearly in FIG. 4*c*. The sealing element can be made of silicon or a similarly acting material.

Figure 4A:
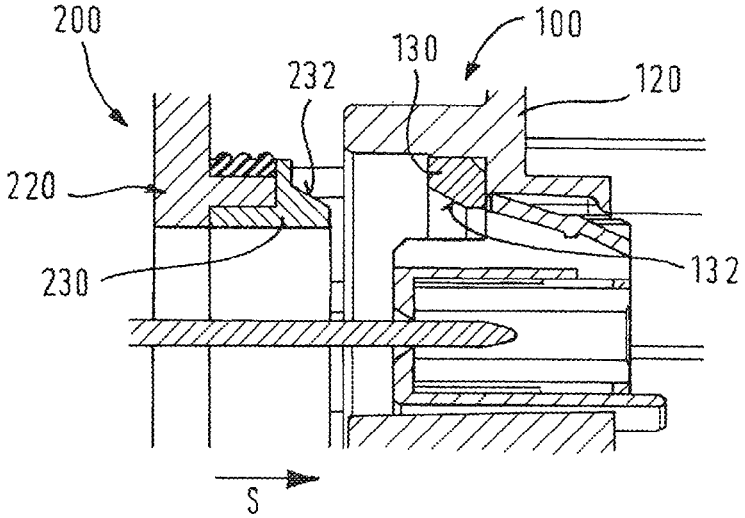
FIG. 4 shows three cross-sectional views of a plug connection according to the invention consisting of a socket part and a plug part in order to illustrate the plugging-in process.
Figure 4B:
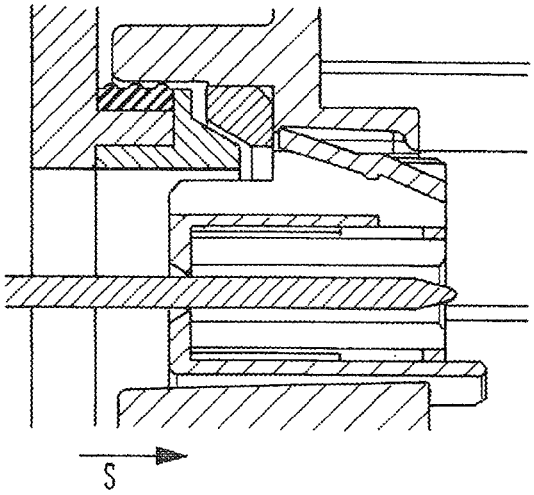
Figure 4C:
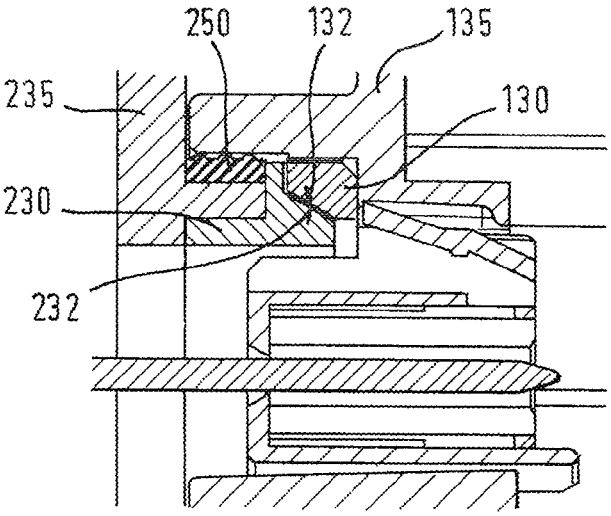

The process of plugging the plug connector 200 into the plug connector 100 is illustrated in three stages in FIGS. 4*a* to 4*c*. In FIG. 4*c*, which shows the plugged-together state, the mating surfaces 132, 232 lie in close contact with one another. Starting out from the aluminum housing 235 of the plug connector 200, the shielding path runs via the pressing point, marked in bold, into the brass outer contact element 230 and continues via the contact region of the two mating surfaces 132, 232 into the brass outer contact element 132 and continues via the pressing point, marked in bold, into the aluminum housing 135 of the plug connector 100. This ensures an extremely low contact resistance while preventing corrosion over a long period of time.

The shield transfer is thereby in each case achieved over a full 360° in a peripheral direction.

Figure 5:
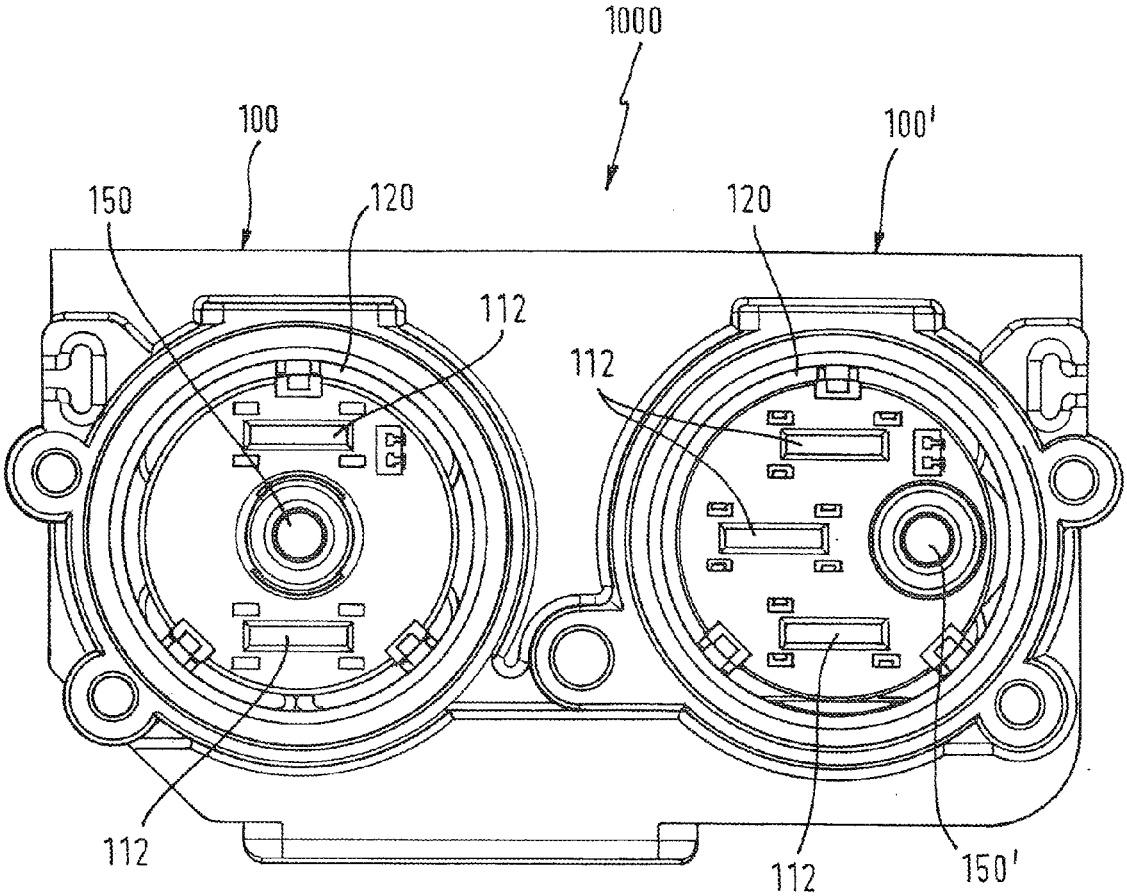
FIG. 5 shows a converter with two plug connectors according to the invention in a frontal view.

FIG. 5 shows a converter such as can be used for example in order to convert a battery DC voltage into an AC voltage for the motor of an electric vehicle. The converter has two plug connectors according to the invention 100, 100' in the form of socket parts. As is shown, the input plug connector 100 has two receiving recesses 112 and a central attachment opening 150 which are surrounded by the outer conductor 120, while the output plug connector 100' has three receiving recesses 112 and a decentrally arranged attachment opening 150'. The two plug connectors 100, 100' are in each case associated with complementary plug connectors which are designed as plug parts. The plug part associated with the input plug connector 100 has two inner contact elements designed as blade-formed elements, and the plug part associated with the output plug connector 100' has three inner contact elements designed in each case as blade-formed elements.

More or fewer than two or three inner conductors as well as differently-formed inner conductors or inner contact elements are also conceivable. More or fewer attachment openings 150, 150' or differently-placed attachment openings and/or attachment elements other than screws or bolts are also covered by the invention. The design of the ring element can differ in its axial cross section as long as it features the oblique mating surface.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector for connecting to a complementarily formed counter plug connector, said plug connector comprising:

an inner conductor which is supplied with high current, and an outer conductor that surrounds the inner conductor and has an outer contact element on a front side of the plug connector for the purposes of shield transfer;

wherein the outer contact element is designed for shield transfer, being in the form of a rigid ring element having a mating surface, surrounding same in a peripheral direction, for surface mating with a complementarily formed counter mating surface of the counter plug connector, said mating surface being inclined at an angle to an insertion direction (S) of the plug connector, such that the outer contact element is pressed into a tubular pressing portion of an electrically conductive housing part of the plug connector for the purpose of shield transfer between the outer contact element and the conductive housing part.

2. The plug connector of claim 1, wherein the mating surface is inclined, at least in sections, at an angle (α) of more than 10°, more than 20°, or about 30° or more, and at an angle of less than 80°, or less than 50°, or less relative to the insertion direction (S) of the plug connector.

3. The plug connector of claim 1, wherein at least in sections, the mating surface tapers or widens conically in the insertion direction (S).

4. The plug connector of claim 1, wherein the mating surface faces radially inwards in the direction of an insertion opening or that the mating surface faces radially outwards.

5. The plug connector of claim 1, where in addition to the obliquely inclined mating surface, the outer contact element has an attachment surface running in the insertion direction (S) and/or perpendicular thereto, which lies in peripheral contact with the housing part, being pressed together there with.

6. The plug connector of claim 1 wherein the housing part is formed of aluminum.

7. The plug connector of claim 1, wherein the outer contact element is formed of brass and/or bronze, the surface thereof being nickel- and/or silver-plated, in the region of the mating surface.

8. The plug connector of claim 1, wherein two, three or more inner conductors surrounded by the outer conductor, each having an inner contact element for making electrical contact with an inner contact element of a counter plug connector.

9. The plug connector of claim 1, including a plug part with at least one pin- or blade-formed inner contact element of the inner conductor projecting in the insertion direction, wherein the mating surface faces radially outwards and tapers conically in the insertion direction (S).

10. The plug connector of claim 1 including a socket part with at least one receiving recess for receiving a pin- or blade-formed contact element of a plug part, wherein the mating surface faces radially inwards and tapers conically in the insertion direction (S) in which a plug part can be inserted into the socket part.

11. The plug connector of claim 2, wherein at least in sections, the mating surface tapers or widens conically in the insertion direction (S).

12. The plug connector of claim 11, wherein the mating surface faces radially inwards in the direction of an insertion opening or that the mating surface faces radially outwards.

13. The plug connector of claim 12, where in addition to the obliquely inclined mating surface, the outer contact element has an attachment surface running in the insertion direction (S) and/or perpendicular thereto, which lies in peripheral contact with the housing part, being pressed together there with.

14. The plug connector of claim 13, wherein two, three or more inner conductors surrounded by the outer conductor, each having an inner contact element for making electrical contact with an inner contact element of a counter plug connector.

15. A plug connection for high current applications with a first plug connector and a complementarily formed counter or second plug connector, said plug connector comprising:

an inner conductor which is supplied with high current, and an outer conductor that surrounds the inner conductor and has an outer contact element on a front side of the plug connector for the purposes of shield transfer;

wherein the outer contact element is designed for shield transfer, being in the form of a rigid ring element having a mating surface, surrounding same in a peripheral direction, for surface mating with a complementarily formed counter mating surface of the counter plug connector, said mating surface being inclined at an angle to an insertion direction (S) of the plug connector, such that the outer contact element is pressed into a tubular pressing portion of an electrically conductive housing part of the plug connector for the purpose of shield transfer between the outer contact element and the conductive housing part;

wherein in a plugged-together state the two outer contact elements, each designed as rigid ring elements, make electrical contact with one another such that the mating surface of the first plug connector lies flat against the mating surface of the counter plug connector.

16. The plug connection of claim 15, wherein an attachment running in the insertion direction (S), at least in sections, through the first plug connector and the second plug connector in order to fix the plug connection in the plugged-together state in a force- and/or form-locking manner.

17. A plug connection for high current applications with a first plug connector and a complementarily formed counter or second plug connector, said plug connector comprising:

an inner conductor which is supplied with high current, and an outer conductor that surrounds the inner conductor and has an outer contact element on a front side of the plug connector for the purposes of shield transfer;

wherein the outer contact element is designed for shield transfer, being in the form of a rigid ring element having a mating surface, surrounding same in a peripheral direction, for surface mating with a complementarily formed counter mating surface of the counter plug connector, said mating surface being inclined at an angle to an insertion direction (S) of the plug connector, such that the outer contact element is pressed into a tubular pressing portion of an electrically conductive housing part of the plug connector for the purpose of shield transfer between the outer contact element and the conductive housing part;

wherein in a plugged-together state the two outer contact elements, each designed as rigid ring elements, make electrical contact with one another such that the mating surface of the first plug connector lies flat against the mating surface of the counter plug connector, wherein an attachment running in the insertion direction (S), at least in sections, through the first plug connector and the second plug connector in order to fix the plug connection in the plugged-together state in a force- and/or form-locking manner; and wherein the attachment has a dowel pin element such as a bolt or a screw which passes through an axial opening in the first plug connector and the second plug connector and which presses the second plug connector against the first plug connector in the insertion direction (S).

18. A converter including two plug connectors, an input plug connector and an output plug connector arranged next to one another, wherein each plug connector comprises:

an inner conductor which is supplied with high current, and an outer conductor that surrounds the inner conductor and has an outer contact element on a front side of the plug connector for the purposes of shield transfer;

wherein the outer contact element is designed for shield transfer, being in the form of a rigid ring element having a mating surface, surrounding same in a peripheral direction, for surface mating with a complementarily formed counter mating surface of the counter plug connector, said mating surface being inclined at an angle to an insertion direction (S) of the plug connector, such that the outer contact element is pressed into a tubular pressing portion of an electrically conductive housing part of the plug connector for the purpose of shield transfer between the outer contact element and the conductive housing part of which the input plug connector is designed to supply an input voltage to the converter, and the output plug connector is designed to conduct a converted output voltage away from the converter.

19. The converter of claim 18 wherein said input voltage is a DC voltage and said output voltage is an AC voltage.

* * * * *